US005536096A

United States Patent [19]

Nowak

[11] Patent Number: 5,536,096

[45] Date of Patent: Jul. 16, 1996

[54] MANUAL BINDING PUNCH FOR SCRAP RECYCLABLE SHEET MATERIAL

[76] Inventor: Leonard A. Nowak, 71 Sam Bonnell Dr., Clinton, N.J. 08809

[21] Appl. No.: 310,725

[22] Filed: Sep. 22, 1994

[51] Int. Cl.[6] ..... B42F 3/00; B26F 1/14

[52] U.S. Cl. ..... 402/1; 402/7; 402/8; 83/687; 83/691

[58] Field of Search ..... 402/1, 7, 8; 29/241; 83/687, 691, 549, 618, 619

[56] References Cited

U.S. PATENT DOCUMENTS

| | | | |
|---|---|---|---|
| 485,102 | 10/1892 | Grantland | 402/1 |
| 2,200,672 | 5/1940 | Kern | 83/618 |
| 3,001,270 | 9/1961 | Friedman | 29/241 |

FOREIGN PATENT DOCUMENTS

| | | | |
|---|---|---|---|
| 12711 | 5/1913 | United Kingdom | 402/7 |

*Primary Examiner*—David P. Bryant

[57] ABSTRACT

Disclosed is a manual binding punch for scrap newspapers, cardboard, and similar recyclable sheet material for shearing a pair of holes through a stack of sheets whereby a plurality of stacks may be bound together with cotton cord to form a bundle. The manual binding punch comprises a punch apparatus having a fixed base portion with a die plate having a pair of spaced apart die apertures integrally formed thereon. A cantilevered lever arm has a pair of end punches for cooperative engagement with the die apertures, a return spring whereby the lever arm and end punches are urged away from the die plate, and a pressure plate whereby sheets being punched are held stationary during punching. The lever arm is pivotable between an open position wherein a stack of sheets may be positioned between the end punches and the die plate and a closed position wherein the pressure plates contact the stack to hold the sheets stationary while the end punches shear a pair of holes therethrough.

14 Claims, 4 Drawing Sheets

MANUAL BINDING PUNCH FOR SCRAP RECYCLABLE SHEET MATERIAL

BACKGROUND OF THE INVENTION

1. Field of the Invention

The present invention relates to punches and more particularly pertains to a manual binding punch for scrap recyclable sheet material which may be adapted for shearing a pair of registered spaced apart holes through an approximately central portion of a stack of scrap newspapers, cardboard, and similar recyclable sheet material whereby a plurality of stacks may be bound together with cotton cord and the like to form a bundle for ease of handling during a recycling process.

2. Description of the Prior Art

The use of punches is known in the prior art. More specifically, punches heretofore devised and utilized for the purpose of shearing holes through sheet material are known to consist basically of familiar, expected and obvious structural configurations, notwithstanding the myriad of designs encompassed by the crowded prior art which have been developed for the fulfillment of countless objectives and requirements.

The present invention is directed to improving devices for shearing holes through sheet material in a manner which is safe, secure, economical and aesthetically pleasing.

Relevant prior art patents include U.S. Pat. No. 5,007,782 to Groswith, III et al. which describes a combined paper punch and binding apparatus and U.S. Pat. No. 4,696,210 to Cain et al. which discloses a two hole automatic precision punch.

The prior art also discloses a binding hole punch apparatus as shown in U.S. Pat. No. 4,175,457 to Jacobs et al. and a precision long reach hole punch of U.S. Pat. No. 3,628,407 to Adams.

U.S. Pat. No. Des. 289,776 to Goertz et al. shows a two hole punch assembly.

While these devices fulfill their respective, particular objectives and requirements, the aforementioned patents do not disclose a manual binding punch for scrap newspapers, cardboard, and similar recyclable sheet material for shearing a pair of registered spaced apart holes through an approximately central portion of a stack of scrap newspapers, cardboard, and similar recyclable sheet material whereby a plurality of stacks may be bound together with cotton cord and the like to form a bundle for ease of handling during a recycling process.

In this respect, the manual binding punch for scrap recyclable sheet material according to the present invention substantially departs from the conventional concepts and designs of the prior art, and in so doing provides an apparatus primarily developed for the purpose of shearing a pair of registered spaced apart holes through an approximately central portion of a stack of scrap newspapers, cardboard, and similar recyclable sheet material whereby a plurality of stacks may be bound together with cotton cord and the like to form a bundle for ease of handling during a recycling process.

Therefore, it can be appreciated that there exists a continuing need for a new manual binding punch for scrap recyclable sheet material which can be used for shearing a pair of registered spaced apart holes through an approximately central portion of a stack of scrap newspapers, cardboard, and similar recyclable sheet material whereby a plurality of stacks may be bound together with cotton cord and the like to form a bundle for ease of handling during a recycling process. In this regard, the present invention substantially fulfills this need.

As illustrated by the background art, efforts are continuously being made in an attempt to develop devices for shearing holes through sheet material. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of punches now present in the prior art, the present invention provides a new punch construction wherein the same can be utilized for shearing a pair of registered spaced apart holes through an approximately central portion of a stack of scrap newspapers, cardboard, and similar recyclable sheet material whereby a plurality of stacks may be bound together with cotton cord and the like to form a bundle for ease of handling during a recycling process. As such, the general purpose of the present invention, which will be described subsequently in greater detail, is to provide a new manual binding punch for scrap recyclable sheet material apparatus and method which has all the advantages of the prior art punches and none of the disadvantages.

The invention is defined by the appended claims with the specific embodiment shown in the attached drawings. For the purpose of summarizing the invention, the invention may be incorporated into a manual binding punch for scrap newspapers, cardboard, and similar recyclable sheet material for shearing a pair of registered spaced apart holes through an approximately central portion of a stack of sheets whereby a plurality of stacks may be bound together with cotton cord and the like to form a bundle for ease of handling during a recycling process.

The manual binding punch for scrap newspapers, cardboard, and similar recyclable sheet material comprises a punch apparatus having a fixed base portion mountable to a vertical planar supporting surface. The fixed base portion comprises an upright hollow flattened casing having an open bottom end. The casing also has a die plate integrally formed on a front face thereof, the die plate having a pair of spaced apart die apertures therethrough opening into the hollow interior of the casing. The casing additionally has a pair of longitudinally oriented spaced apart ears projecting normal the front face thereof from adjacent lower corners thereof, each ear having a central lateral hole therethrough.

The casing further has a longitudinal through slot formed through opposing side edges thereof and at least two key holes through a rear face thereof whereby the base portion may be mounted to the supporting surface.

A movable punch portion is pivotally connected to the base portion. The movable punch portion comprises a flattened cantilevered lever arm having a pair of spaced apart tabs projecting longitudinally from a lower end thereof, each tab having a central lateral hole therethrough. A bolt extends through the holes of the ears. The bolt also extends through the holes of the tabs whereby pivotally connecting the lever arm to the base portion. The bolt is further threadedly engaged with a nut whereby securing the bolt in the holes. A pair of end punches projects from a rear face of the lever arm. Each end punch has a concavely formed sharpened punching end for cooperative engagement with a die aperture to provide a hole shearing action upon sheets placed between the punch and die. Each end punch is aligned on the lever arm to operably engage a corresponding die aperture when the lever arm is pivoted to it's uppermost position.

A return spring is coaxially disposed over each end punch whereby the lever arm and the end punches are urged away from the die plate. Each return spring is fixedly connected at an upper end thereof to the lever arm. Each return spring additionally has a discoid pressure plate fixedly coaxially connected to a lower end thereof whereby sheets being punched are held stationary against the die plate during the punching operation. Each pressure plate has a central aperture therethrough wherethrough extends the punching end of an end punch.

An enlarged gripping portion is formed on an upper end of the lever arm whereby the lever arm is pivotable to a lower open position wherein a stack of sheets to be punched may be positioned between the end punches and the die plate. The lever arm is also pivotable to an upper closed position wherein the pressure plates contact the stack of sheets to hold the sheets stationary while the end punches shear a pair of holes through the stack. The punched out portions of the stack are forced through the die openings and into the hollow casing whereupon the lever arm and punches are again urged away from the die plate by expansion of the return springs.

An adjustable sheet stack guide registers the pair of holes on the stack such that the pairs of holes through all the stacks in a bundle align with each other to permit passage of the binding cord therethrough. The adjustable sheet stack guide comprises a flat bar extending through the longitudinal through slots of the casing. The bar has first and second ends projecting beyond both exterior side edges of the casing. The bar also has an integrally formed stop tab projecting upwardly from the first end thereof whereagainst edges of a stack of sheets may be aligned. The bar is frictionally engaged with the slots such that the frictional resistance normally holding the bar stationary may be overcome for sliding the bar longitudinally to vary the distance between the stop tab and the pair of die apertures.

A removable bottom closure prevents the punched out portions of the stack from falling from inside the hollow casing. The bottom closure comprises a rigid plug frictionally engaged with the opening at the bottom end of the casing such to close the opening. The plug has an enlarged gripping portion extending outside the casing. The gripping portion has a lateral gripping tab projecting from adjacent lower corners thereof which extend beyond the exterior sides of the casing whereby the plug may be grasped to facilitate removal thereof for emptying the casing of punched out portions of the stack.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a manual binding punch for scrap newspapers, cardboard, and similar recyclable sheet material for shearing a pair of registered spaced apart holes through an approximately central portion of a stack of sheets whereby a plurality of stacks may be bound together with cotton cord and the like to form a bundle for ease of handling during a recycling process.

It is another object of the present invention to provide a new manual binding punch for scrap recyclable sheet material which may be easily and efficiently manufactured and marketed.

It is a further object of the present invention to provide a new manual binding punch for scrap recyclable sheet material which is of a durable and reliable construction.

An even further object of the present invention is to provide a new manual binding punch for scrap recyclable sheet material which is susceptible of a low cost of manufacture with regard to both materials and labor, and which accordingly is then susceptible of low prices of sale to the consuming public, thereby making such manual binding punches for scrap recyclable sheet material economically available to the buying public.

Still yet another object of the present invention is to provide a new manual binding punch for scrap recyclable sheet material which provides in the apparatuses and methods of the prior art some of the advantages thereof, while simultaneously overcoming some of the disadvantages normally associated therewith.

Still yet another object of the present invention is to provide a manual binding punch for scrap newspapers, cardboard, and similar recyclable sheet material which provides a way to easily assemble and bind the punched stacks of sheets.

Yet another object of the present invention is to provide a manual binding punch for scrap newspapers, cardboard, and similar recyclable sheet material which is constructed of weather resistant components enabling it to be used outdoors.

Even still another object of the present invention is to provide a manual binding punch for scrap newspapers, cardboard, and similar recyclable sheet material that is able to pierce a stack of sheets of at least ¼ inch in thickness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
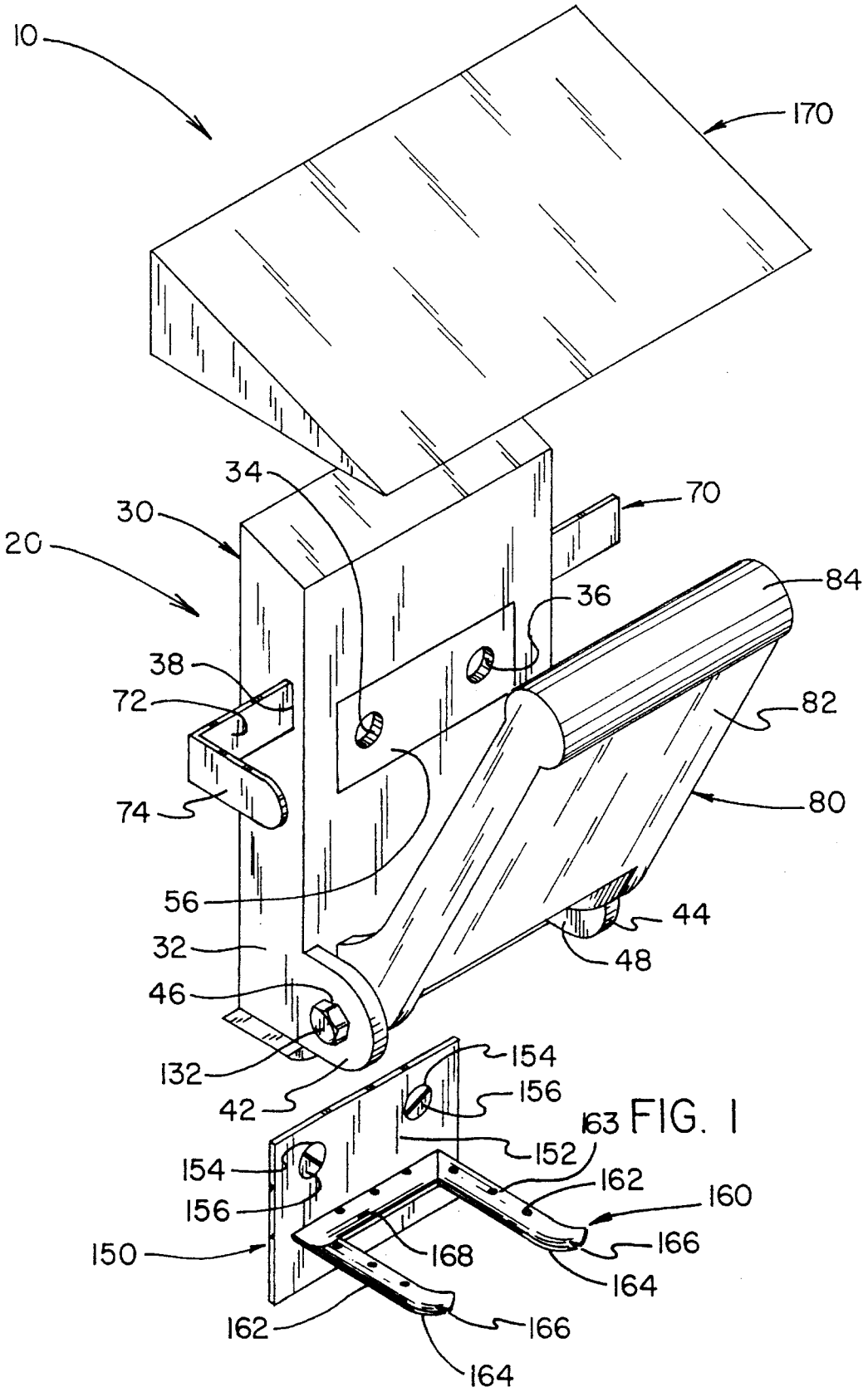
FIG. 1 is a top front perspective view of the preferred embodiment of the present invention manual binding punch for scrap newspapers, cardboard, and similar recyclable sheet material.
Figure 2:
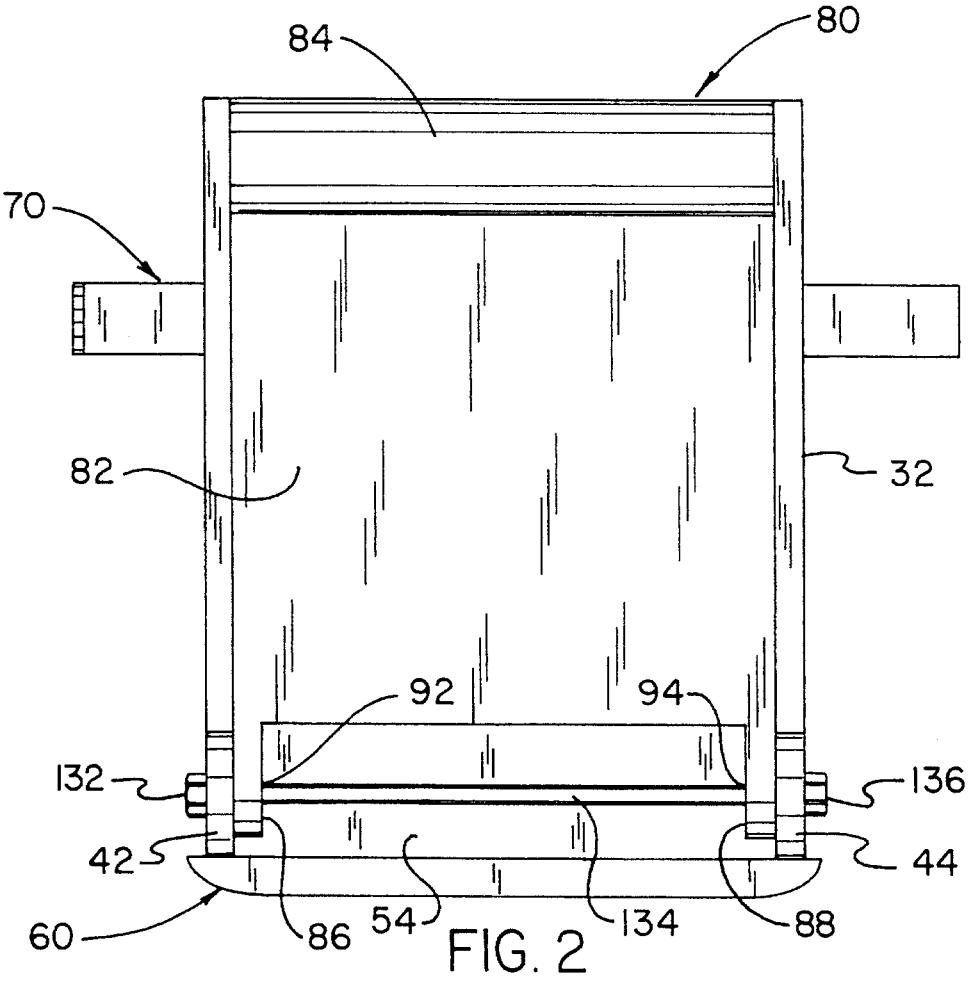
FIG. 2 is a front elevational view of the punch of the invention of FIG. 1.
Figure 3:
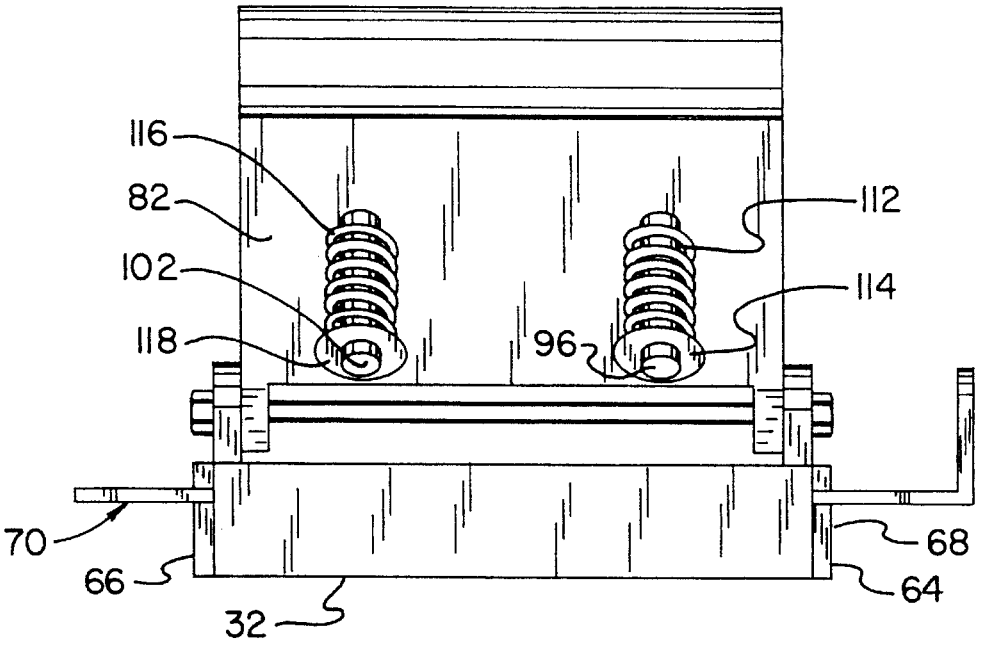
FIG. 3 is a top plan view of the invention of FIG. 2.
Figure 4:
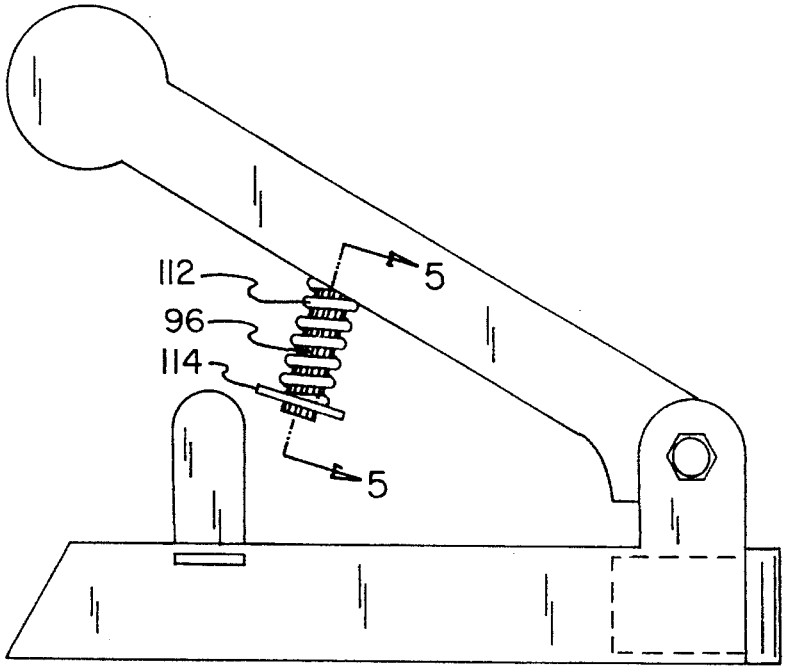
FIG. 4 is a side elevational view of the invention of FIG. 2.
Figure 5:
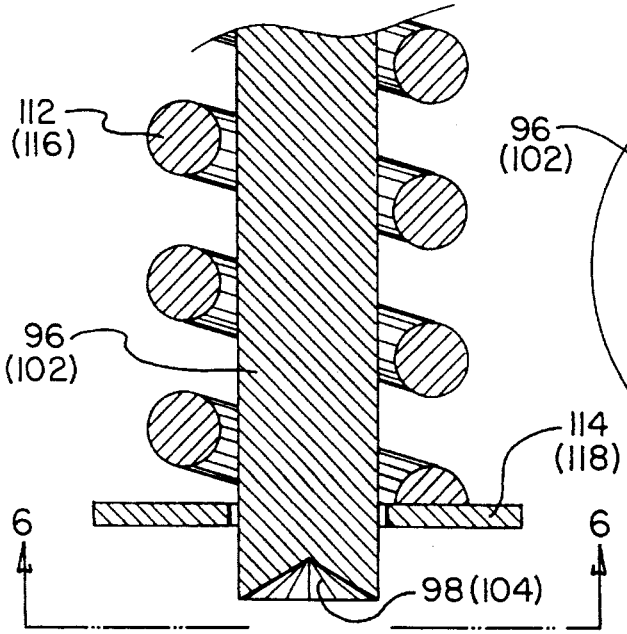
FIG. 5 is a sectional view of the invention of FIG. 4 taken along the line 5—5.
Figure 6:
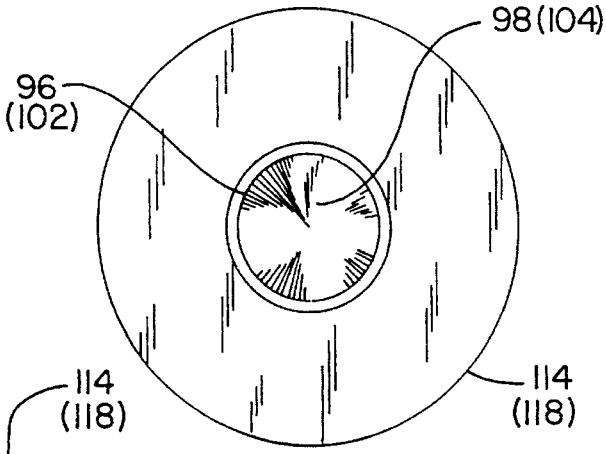
FIG. 6 is a bottom plan detail view of the invention of FIG. 5 taken along the line 6—6.

With reference now to the drawings, and in particular to FIG. 1 thereof, a manual binding punch for scrap newspapers, cardboard, and similar recyclable sheet material embodying the principles and concepts of the present invention and generally designated by the reference numeral 10 will be described.

From an overview standpoint, the manual binding punch for scrap newspapers, cardboard, and similar recyclable sheet material is adapted for use for shearing a pair of registered spaced apart holes through an approximately central portion of a stack of scrap newspapers, cardboard, and similar recyclable sheet material whereby a plurality of stacks may be bound together with cotton cord and the like to form a bundle for ease of handling during a recycling process. See FIG. 1.

With reference now to FIGS. 1–8 and more specifically, it will be noted that a manual binding punch for scrap newspapers, cardboard, and similar recyclable sheet material 10 is shown.

The manual binding punch for scrap newspapers, cardboard, and similar recyclable sheet material 10 comprises a punch apparatus 20 having a fixed base portion 30 mountable to a vertical planar supporting surface. The fixed base portion 30 comprises an upright hollow flattened casing 32 formed of aluminum alloy and having an open bottom end 54. The casing 32 also has a stainless steel die plate 56 formed on a front face thereof, the die plate 56 having a pair of die apertures 34 and 36 therethrough spaced on 6 inch centers and opening into the hollow interior 58 of the casing 32. The casing 32 additionally has a pair of integrally formed longitudinally oriented spaced apart ears 42 and 44 projecting normal the front face thereof from adjacent lower corners thereof, each ear having a central lateral hole 46 and 48 therethrough.

The casing 32 further has a longitudinal through slot 38 formed through opposing side edges thereof and three keyholes 52, arranged in an inverted triangle pattern, through a rear face thereof whereby the base portion 30 may be mounted to the supporting surface.

A movable punch portion 80 is pivotally connected to the base portion 30. The movable punch portion 80 comprises a flattened cantilevered lever arm 82 formed of aluminum alloy and having a pair of integrally formed spaced apart tabs 86 and 88 projecting longitudinally from a lower end thereof. Each tab has a central lateral hole 92 and 94 therethrough. A stainless steel bolt 132 extends through the holes 46 and 48 of the ears 42 and 44. The bolt 132 also extends through the holes 92 and 94 of the tabs 86 and 88 whereby pivotally connecting the lever arm 82 to the base portion 30. The bolt 132 is threadedly engaged with a stainless steel nut 136 whereby securing the bolt in the holes. A pair of stainless steel end punches 96 and 102 project from a rear face of the lever arm 82. Each end punch 96 and 102 has a concavely formed sharpened punching end 98 and 104 for cooperative engagement with a die aperture 34 and 36 to provide a hole shearing action upon sheets placed between the punch and die. Each end punch 96 and 102 is aligned on the lever arm to operably engage a corresponding die aperture 34 and 36 when the lever arm 82 is pivoted to it's uppermost position.

As shown in FIGS. 3–6, a zinc plated steel return spring 112 and 116 is coaxially disposed over each end punch 96 and 102 whereby the lever arm 82 and the end punches 96 and 102 are urged away from the die plate 56. Each return spring 112 and 116 is fixedly connected at an upper end thereof to the lever arm 82. Each return spring 112 and 116 additionally has a stainless steel discoid pressure plate 114 and 118 fixedly coaxially connected to a lower end thereof whereby sheets being punched are held stationary against the die plate 56 during the punching operation. Each pressure 114 and 118 plate has a central aperture therethrough wherethrough extends the punching end of an end punch 96 and 102.

An enlarged gripping portion 84 is integrally formed on an upper end of the lever arm 82 whereby the lever arm is pivotable to a lower open position wherein a stack of sheets to be punched may be positioned between the end punches 96 and 102 and the die plate 56. The lever arm 82 is also pivotable to an upper closed position wherein the pressure plates 114 and 118 contact the stack of sheets to hold the sheets stationary while the end punches 96 and 102 shear a pair of holes through the stack. The punched out portions of the stack are forced through the die 34 and 36 openings and into the hollow casing 32 whereupon the lever arm 82 and punches 96 and 102 are again urged away from the die plate 56 by expansion of the return springs 112 and 116.

An adjustable sheet stack guide 70 registers the pair of holes on the stack such that the pairs of holes through all the stacks in a bundle align with each other to permit passage of the binding cord therethrough. The adjustable sheet stack guide 70 comprises a flat nickel plated steel bar 72 extending through the longitudinal through slots 38 of the casing 32. The bar 72 has first and second ends projecting beyond both exterior side edges of the casing 32. The bar 72 also has an integrally formed stop tab 74 projecting upwardly from the first end thereof whereagainst edges of a stack of sheets may be aligned. The bar 72 is frictionally engaged with the slots 38 such that the frictional resistance normally holding the bar stationary may be overcome for sliding the bar 72 longitudinally to vary the distance between the stop tab 74 and the pair of die apertures 34 and 36.

Figure 8:
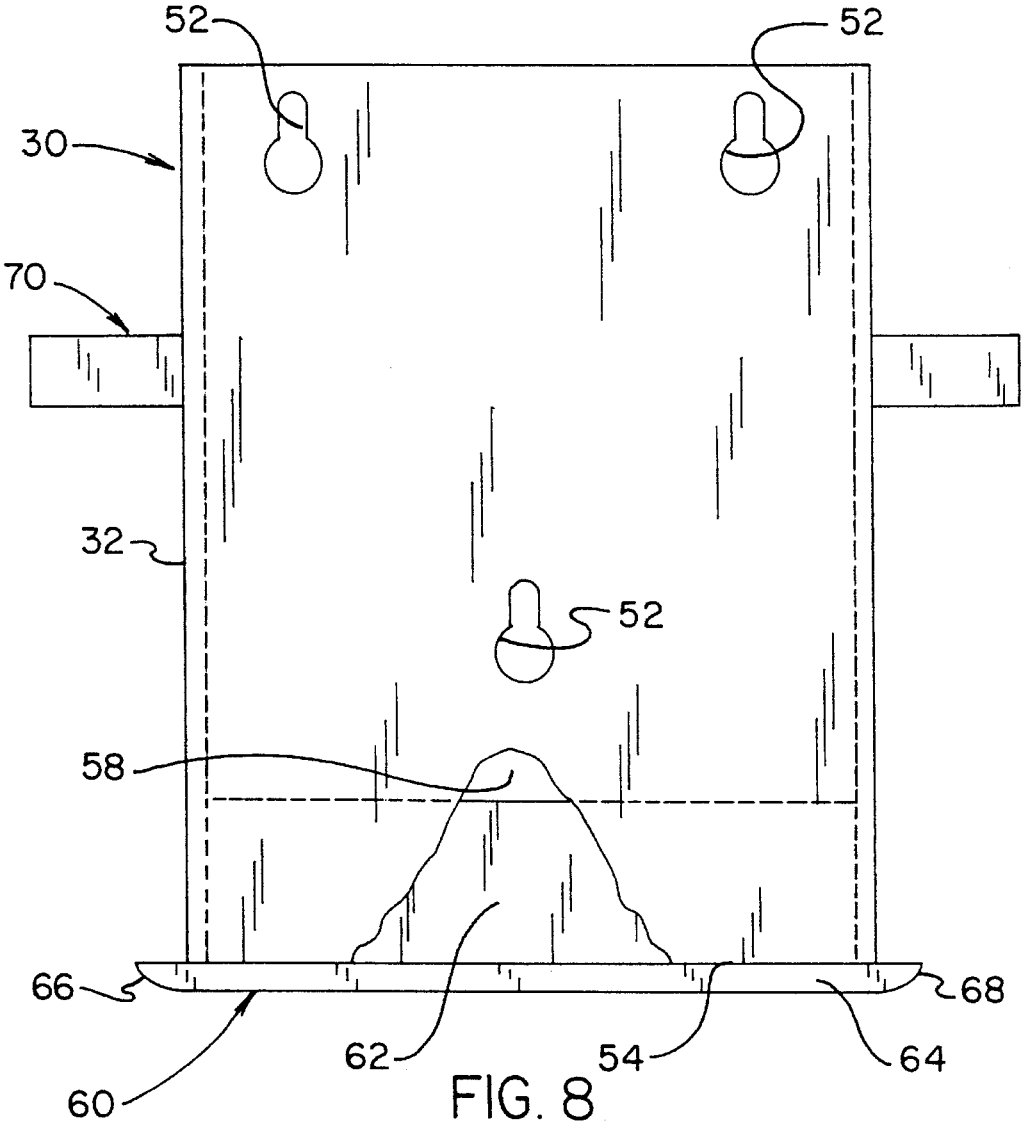
FIG. 8 is a partially cutaway rear elevational view of the invention of FIG. 2 showing the mounting keyholes and the manner of engagement of the bottom closure.

A removable bottom closure 60, best seen in FIG. 8, prevents the punched out portions of the stack from falling from inside the hollow casing 32. The bottom closure 60 comprises a rigid plastic plug 62 frictionally engaged with the opening 54 at the bottom end of the casing 32 such to close the opening. The plug 62 has an integrally formed enlarged gripping portion 64 extending outside the casing 32. The gripping portion 64 has an integrally formed lateral gripping tab 66 and 68 projecting from adjacent lower corners thereof which extend beyond the exterior sides of the casing 32 whereby the plug 62 may be grasped to facilitate removal thereof for emptying the casing 32 of punched out portions of the stack.

Referring particularly now to FIG. 1, the preferred embodiment of the manual binding punch for scrap newspapers, cardboard, and similar recyclable sheet material 10 further includes a binding rack 150 whereupon punched stacks of sheets may be hung for assembly and binding into a bundle. The binding rack 150 comprises an upright generally planar nickel plated steel mounting flange 152 mountable to the vertical planar supporting surface spaced below the punch apparatus 20. The flange 152 has a pair of holes 154 therethrough wherethrough a pair of stainless steel mounting screws 156 may extend. A bifurcated nickel plated steel spindle 160 has two laterally spaced apart spindle arms 162 connected together at one end by an integral cross member 168. The spindle 160 has a perforated U-shaped cross sectionally to define an upwardly opening channel wherein binding cord may be disposed to form an open-ended loop, yet the perforations 163 allow for water drainage from the channel. The spindle arms 162 have a spacing corresponding to the spacing of the die apertures 34 and 36.

The cross member 168 is fixedly connected to the flange 152 such that the spindle arms 162 project normally therefrom whereby punched stacks of sheets may be spindled through the holes. Each spindle arm 162 has a slightly upturned end 164 for retaining the stacks of sheets thereon. Each upturned end 164 has a longitudinal V-slot 166 formed thereon wherein the ends of the binding cord loop may be engaged during assembly of the stacks into a bundle. When enough stacks have been placed on the spindle 160 to make up a bundle, the ends of the binding cord loop may be disengaged from the V-slots 166 for tying together to bind the bundle.

Figure 7:
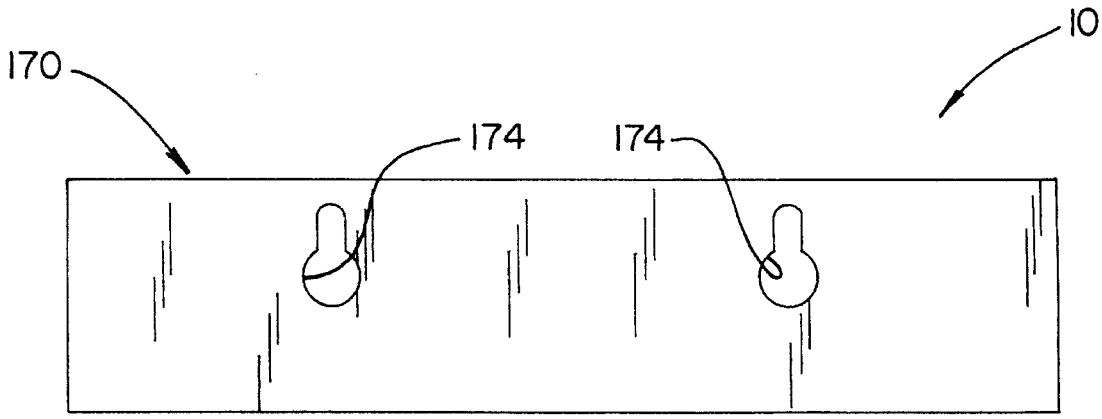
FIG. 7 is a rear elevational view of the rain canopy of the invention of FIG. 1 showing the mounting keyholes.

Referring now to FIGS. 1 and 7, a rain canopy structure 170 is further included with the preferred embodiment for protecting the punching apparatus from precipitation when used outdoors. The rain canopy structure 170, mountable with a pair of keyholes 174 to the vertical planar supporting surface spaced above the punch apparatus 20, may be of any suitable design and constructed of any suitable material to meet the unique aesthetic and environmental requirements of a particular site.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A manual binding punch for recyclable sheet material for shearing a pair of registered spaced apart holes through an approximately central portion of a stack of sheets whereby a plurality of stacks may be bound together with cotton cord to form a bundle for ease of handling during a recycling process, the manual binding punch for recyclable sheet material comprising:

a punch apparatus having a fixed base portion mountable to a vertical planar supporting surface, the fixed base portion comprising an upright hollow flattened casing having an open bottom end, the casing also having a die plate integrally formed on a front face thereof, the die plate having a pair of spaced apart die apertures therethrough opening into the hollow interior of the casing, the casing additionally having a pair of longitudinally oriented spaced apart ears projecting normal the front face thereof from adjacent lower corners thereof, each ear having a central lateral hole therethrough, the casing further having a longitudinal through slot formed through opposing side edges thereof and at least two key holes through a rear face thereof whereby the base portion may be mounted to the supporting surface;

a movable punch portion pivotally connected to the base portion, the movable punch portion comprising: a flattened cantilevered lever arm having a pair of spaced apart tabs projecting longitudinally from a lower end thereof, each tab having a central lateral hole therethrough; a bolt extending through the holes of the ears, the bolt also extending through the holes of the tabs whereby pivotally connecting the lever arm to the base portion, the bolt further being threadedly engaged with a nut whereby securing the bolt in the holes; a pair of end punches projecting from a rear face of the lever arm, each end punch having a concavely formed sharpened punching end for cooperative engagement with a die aperture to provide a hole shearing action upon sheets placed between the end punches and the die plate, each end punch being aligned on the lever arm to operably engage a corresponding die aperture when the lever arm is pivoted to it's uppermost position; a return spring coaxially disposed over each end punch whereby the lever arm and the end punches are urged away from the die plate, each return spring being fixedly connected at an upper end thereof to the lever arm, each return spring additionally having a discoid pressure plate fixedly coaxially connected to a lower end thereof whereby sheets being punched are held stationary against the die plate during the punching operation, each pressure plate having a central aperture therethrough wherethrough extends the punching end of an end punch; and an enlarged gripping portion formed on an upper end of the lever arm whereby the lever arm is pivotable to a lower open position wherein a stack of sheets to be punched may be positioned between the end punches and the die plate, the lever arm also being pivotable to an upper closed position wherein the pressure plates contact the stack of sheets to hold the sheets stationary while the end punches shear a pair of holes through the stack, the punched out portions of the stack being forced through the die openings and into the hollow casing whereupon the lever arm and punches are again urged away from the die plate by expansion of the return springs;

an adjustable sheet stack guide whereby the pair of holes may be registered on the stack such that the pairs of holes through all the stacks in a bundle align with each other to permit passage of a binding cord therethrough, the adjustable sheet stack guide comprising a flat bar extending through the longitudinal through slots of the casing, the bar having first and second ends projecting beyond both exterior side edges of the casing, the bar also having an integrally formed stop tab projecting upwardly from the first end thereof whereagainst edges of a stack of sheets may be aligned, the bar being frictionally engaged with the slots such that the frictional resistance normally holding the bar stationary may be overcome for sliding the bar longitudinally to vary the distance between the stop tab and the pair of die apertures; and a removable bottom closure for preventing the punched out portions of the stack from falling from inside the hollow casing, the bottom closure comprising a rigid plug frictionally engaged with the opening at the bottom end of the casing such to close the opening, the plug having an enlarged gripping portion extending outside the casing, the gripping portion having a lateral gripping tab projecting from adjacent lower corners thereof which extend beyond the exterior sides of the casing whereby the plug may be grasped to facilitate removal thereof for emptying the casing of punched out portions of the stack.

2. The manual binding punch for recyclable sheet material of claim 1 and further including a binding rack whereupon punched stacks of sheets may be hung for assembly and binding into a bundle, the binding rack comprising: an upright generally planar mounting flange mountable to the vertical planar supporting surface spaced below the punch apparatus, the flange having at least two holes therethrough wherethrough mounting screws may extend; a bifurcated spindle having two laterally spaced apart spindle arms connected together at one end by an integral cross member, the spindle being cross sectionally U-shaped to define an upwardly opening channel wherein binding cord may be disposed to form an open-ended loop, the spindle arms having a spacing corresponding to the spacing of the die apertures, the cross member being fixedly connected to the flange such that the spindle arms project normally therefrom whereby punched stacks of sheets may be spindled through the holes, each spindle arm having a slightly upturned end for retaining the stacks of sheets thereon, each upturned end having a longitudinal V-slot formed thereon wherein the ends of the binding cord loop may be engaged during assembly of the stacks into a bundle whereupon the ends of the binding cord loop may be disengaged from the V-slots for tying together to bind the bundle.

3. The manual binding punch for recyclable sheet material of claim 2 and further including a rain canopy structure mountable to the vertical planar supporting surface spaced above the punch apparatus for protecting the binding punch from precipitation when the binding punch is used outdoors.

4. The manual binding punch for recyclable sheet material of claim 3 wherein all components thereof are formed of weather resistant materials.

5. The manual binding punch for recyclable sheet material of claim 4 wherein the spacing between the die apertures falls within the range of 6 inches to 8 inches.

6. A manual binding punch for recyclable sheet material for shearing a pair of spaced apart holes through an approximately central portion of a stack of sheets whereby a plurality of stacks may be bound together with cotton cord to form a bundle for ease of handling during a recycling process, the manual binding punch for scrap recyclable sheet material comprising:

a punch apparatus having a fixed base portion with a die plate integrally formed thereon, the die plate having a pair of spaced apart die apertures therethrough;

a movable punch portion pivotally connected to the base portion, the movable punch portion comprising: a cantilevered lever arm having a pair of end punches projecting therefrom for cooperative engagement with the die apertures, the lever arm also having a return spring coaxially disposed over each end punch whereby the lever arm and the end punches are urged away from the die plate, each return spring additionally having a pressure plate fixedly coaxially connected to a lower end thereof whereby sheets being punched are held stationary against the die plate during the punching operation, the lever arm being pivotable to an open position wherein a stack of sheets to be punched may be positioned between the end punches and the die plate, the lever arm also being pivotable to a closed position wherein the pressure plates contact the stack of sheets to hold the sheets stationary while the end punches shear a pair of holes through the stack;

containing means for trapping and retaining punched out portions of the stacks, the containing means having removable closure means whereby the containing means may be emptied when full; and adjustable guide means whereby the pair of holes may be registered on the stack such that the pairs of holes through all the stacks in a bundle align with each other to permit passage of a binding cord therethrough.

7. The manual binding punch for recyclable sheet material of claim 6 and further including at least two key holes through a rear face of the base portion whereby the base portion may be mounted to a vertical planar supporting surface.

8. The manual binding punch for recyclable sheet material of claim 7 wherein the containing means comprises a cavity formed in the base portion, the cavity being in communicating relationship with the die apertures wherethrough the punched out portions of the stacks are forced during a punching operation, the cavity having an opening wherethrough the punched out portions of the stacks may be emptied.

9. The manual binding punch for recyclable sheet material of claim 8 wherein the removable closure means comprises a removable closure for preventing the punched out portions of the stack from falling from inside the cavity, the closure comprising a rigid plug frictionally engaged with the opening of the cavity such to close the opening, the plug having an enlarged gripping portion whereby the plug may be grasped to facilitate removal thereof for emptying the cavity of punched out portions of the stack.

10. The manual binding punch for recyclable sheet material of claim 9 wherein the adjustable guide means comprises a flat bar extending through longitudinal slots through side edges of the base portion, the bar having first and second ends projecting beyond both exterior side edges of the base portion, the bar also having an integrally formed stop tab projecting upwardly from the first end thereof whereagainst edges of a stack of sheets may be aligned, the bar being frictionally engaged with the slots such that the frictional resistance normally holding the bar stationary may be overcome for sliding the bar longitudinally to vary the distance between the stop tab and the pair of die apertures.

11. The manual binding punch for recyclable sheet material of claim 10 and further including a binding rack whereupon a punched stacks of sheets may be hung for assembly and binding into a bundle, the binding rack comprising: an upright generally planar mounting flange mountable to the vertical planar supporting surface spaced below the punch apparatus, the flange having at least two holes therethrough wherethrough mounting screws may extend; a bifurcated spindle having two laterally spaced apart spindle arms connected together at one end by an integral cross member, the spindle being cross sectionally U-shaped to define an upwardly opening channel wherein binding cord may be disposed to form an open-ended loop, the spindle arms having a spacing corresponding to the spacing of the die apertures, the cross member being fixedly connected to the flange such that the spindle arms project normally therefrom whereby punched stacks of sheets may be spindled through the holes, each spindle arm having a slightly upturned end for retaining the stacks of sheets thereon, each upturned end having a longitudinal V-slot formed thereon wherein the ends of the binding cord loop may be engaged during assembly of the stacks into a bundle whereupon the ends of the binding cord loop may be disengaged from the V-slots for tying together to bind the bundle.

12. The manual binding punch for recyclable sheet material of claim 11 and further including a rain canopy structure mountable to the vertical planar supporting surface spaced above the punch apparatus for protecting the binding punch from precipitation when the binding punch is used outdoors.

13. The manual binding punch for recyclable sheet material of claim 12 wherein all components thereof are formed of weather resistant materials.

14. The manual binding punch for recyclable sheet material of claim 13 wherein the spacing between the die apertures falls within the range of 6 inches to 8 inches.

* * * * *